US005101422A

United States Patent [19]

Thiel et al.

[11] Patent Number: 5,101,422

[45] Date of Patent: Mar. 31, 1992

[54] MOUNTING FOR X-RAY CAPILLARY

[75] Inventors: Daniel J. Thiel, Ithaca; Donald H. Bilderback, Brooktondale; Aaron Lewis, Ithaca, all of N.Y.; Edward A. Stern, Seattle, Wash.

[73] Assignee: Cornell Research Foundation, Inc., Ithaca, N.Y.

[21] Appl. No.: 607,038

[22] Filed: Oct. 31, 1990

[51] Int. Cl.[5] ..... G21K 1/00

[52] U.S. Cl. ..... 378/145; 378/147

[58] Field of Search ..... 378/145, 147, 119

[56] References Cited

U.S. PATENT DOCUMENTS

| | | | |
|---|---|---|---|
| 3,821,510 | 10/1974 | Muncheryan . | |
| 4,063,088 | 9/1977 | Dailey . | |
| 4,122,342 | 10/1978 | Vali et al. | 378/119 |
| 4,143,275 | 3/1979 | Mallozzi | 378/119 |
| 4,213,672 | 6/1980 | Aulich et al. . | |
| 4,692,934 | 10/1987 | Forsyth . | |
| 4,780,903 | 10/1988 | Soezima | 378/119 |
| 4,821,151 | 12/1989 | Graser et al. . | |
| 4,917,462 | 1/1990 | Lewis et al. . | |
| 4,921,327 | 1/1990 | Zito . | |

OTHER PUBLICATIONS

"Oriel Motorized Mirror Mount", pp. 202-203.

"Simple Method for Focusing X Rays Using Tapered Capillaries" Stern et al, pp. 5135-5139 15 Dec. 1988 vol. 27, No. 24 Applied Optics.

*Primary Examiner*—Craig E. Church

*Attorney, Agent, or Firm*—Jones, Tullar & Cooper

[57] ABSTRACT

The ends of a tapered glass capillary are secured in relatively movable mounting blocks for application of axial tension to the capillary. This mounting enables the capillary to be pulled taut so that its axis is straight to facilitate propagation of X-rays. The capillary is coated to provide flexibility and strength. The ends of the capillary extend into their respective mounting blocks, with at least a portion of each end being stripped of the coating material. A bonding material contacts the glass and the coating material and secures both to their corresponding mounting blocks to hold the capillary in place when tension is applied and to provide shear strength for the capillary wall.

15 Claims, 1 Drawing Sheet

MOUNTING FOR X-RAY CAPILLARY

BACKGROUND OF THE INVENTION

This invention was made with Government support under Grant No. R01 GM 39803, awarded by the National Institute of Health. The Government has certain rights in the invention. The present invention relates to apparatus for guiding X-rays along the hollow bore of a tapered glass capillary, and more particularly to a method and apparatus for securing such a capillary so that it is sufficiently straight to propagate X-rays.

Edward A. Stern et al, in an article entitled "Simple Method for Focusing X-Rays Using Tapered Capillaries", *Applied Optics*, Vol. 27, No. 24, Dec. 15, 1988, pages 5135 to 5139, provided a thorough analysis of the method of focusing X-rays through the use of tapered capillaries. As pointed out by Stern et al, for many uses of X-rays it is necessary or desirable to focus them into a very small spatial region. The standard methods for doing this require very precise dimensions in the focusing elements, on the order of microns or less, and consequently such focusing typically has been difficult and expensive. As described in the *Applied Optics* article, however, X-rays can be focused by the use of a capillary which has an entrance opening having the dimension of the incident X-ray beam and having an exit opening which has the dimension which is desired for the focused beam. The X-ray beam which is to be focused is directed into a capillary so that the rays impinge on the inner surface of the capillary wall at angles below the critical glancing angle and reflect from that inner surface due to total external reflection so that the capillary acts as a waveguide. By appropriately narrowing the capillary along its length, the X-rays are concentrated over a broad band of energies so that the X-rays which pass through the central aperture of the capillary are, in effect, focused when they pass out the small end of the capillary, since the cross-sectional dimension of the beam is reduced and its intensity is increased.

Very short, rapidly tapering glass capillaries may be formed, as by drawing, to produce elongated glass tubes having an internal surfaces which taper inwardly from their inlet ends to their outlet ends for use in aperture visible light, as described in U.S. Pat. No. 4,917,462 to Isaacson et al. Because of critical angle limitations for X-rays, however, capiillaries fabricated for X-ray focusing must be very different than those used for aperturing visible light.

In the *Applied Optics* article, an untapered glass capillary is used to provide intensity enhancement of X-rays, and this capillary rested on a coextensive support, such as a V-groove formed in a metal plate. According to that article, a tapered capillary needs to be several meters long in order to concentrate a 500 micrometer diameter beam to a spot 10 micrometers in diameter. It has been found that the provision of a tapered glass tube of this length creates problems in handling, and that resting such a capillary on a metal plate does not maintain its linearity within necessary tolerances to maximize the output of X-rays. Although capillaries are inexpensive and simple to fabricate, and do not require the extreme precision of dimensions or shape necessary with the methods of focusing utilizing mirrors and zone plates currently in use, nevertheless it has been found that it is necessary to maintain such a capillary linear within a fraction of a milliradian of resolution to prevent absorption of the X-rays by the glass wall as they propagate along the capillary bore. Furthermore, because the glass tube is fragile, it is desirable to provide a coating on the exterior surface of the tube to give it strength and flexibility. However, such a coating can interfere with the ability to maintain the linearity of the capillary.

SUMMARY OF THE INVENTION

In accordance with the present invention, a glass capillary is formed, as by heating a glass tube and drawing it slowly to extend its length, to produce the desired taper to both the exterior surface and to the interior bore. The capillary is then provided with a plastic coating which is applied to the exterior surface of the glass to give it improved strength and flexibility. The linearity of the interior bore is obtained, in accordance with the invention, by gripping the two ends of the capillary, and pulling the capillary taut. It has been found that the tensile strength of glass is sufficiently high to permit application of tensile forces sufficiently great to remove sag from the capillary. However, shear forces can easily break the glass at its securing points, and accordingly the gripping mechanism must be carefully constructed.

A securing mechanism for gripping the glass, in accordance with the invention, includes a vertical metal support at each end of the tube, each support having a central aperture into which the corresponding end of the tube is inserted. The tube is then secured to the support by a suitable adhesive such as an epoxy. However, since the plastic coating can break loose from the glass and cause slippage when a large tension is applied, in accordance with the invention the plastic coating is stripped partially away from the glass in the region of the two end supports so that the supports are secured in part to the glass and in part to the plastic coating. The adhesive bond between the glass and the metal support is very strong and can withstand the necessary tension to enable the capillary to be pulled taut. Furthermore, the bond between the plastic coating and the metal support has been found to serve as a strain relief on the glass tube to prevent shear forces due to the weight of the capillary from breaking the glass at its junction with the support.

In order to propagate X-rays through the tapered capillary, it is necessary to ensure that the ends of the capillary, where they are connected to the supports, are aligned with the axis of the capillary between the supports. In order to do this, the vertical metal supports are secured in gimbal mountings which are adjustable around two axes to permit the end portions of the capillaries to be adjusted and aligned with the axis of the capillary. The gimbals have motorized controls so that alignment can be done remotely, allowing the device to be used, for example, in a radiation area without exposing the operator to radiation while the capillary as being aligned with the X-rays.

It has also been found that air in a capillary tends to absorb X-rays, and a capillary 1.6 meters long, for example, contains enough air to reduce the flux density of 8 keV X-rays by a factor of 5. However, helium is transparent to X-rays, and by supplying helium under pressure to the large end of the tapered capillary, a very small flow of helium will occur through the capillary. The flow from the large end to the small end is made sufficient to push all of the air out of the capillary bore to thereby improve the flux density at the output of the capillary.

Thus, the present invention provides a tapered, helium-filled, cladded glass X-ray optical capillary, or fiber, that will concentrate a beam of X-rays to a high intensity spot to effectively focus the X-ray beam.

BRIEF DESCRIPTION OF THE DRAWINGS

The foregoing, and additional objects, features, and advantages of the present invention will become apparent to those of skill in the art from the following detailed description of a preferred embodiment thereof, taken in conjunction with the accompanying drawings, in which.

DESCRIPTION OF PREFERRED EMBODIMENT

Figure 1:
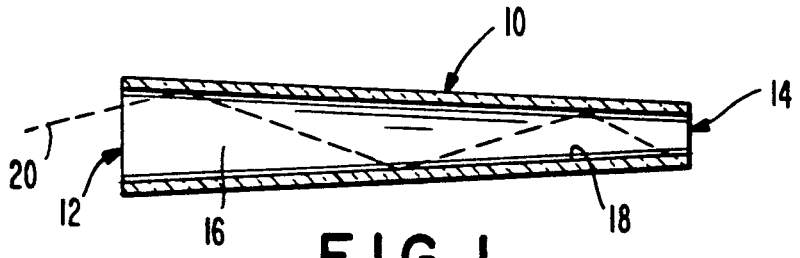
FIG. 1 is a diagrammatic illustration of a tapered capillary for concentrating X-rays.

FIG. 1 illustrates in diagrammatic form a glass capillary 10 which tapers from a large end 12 to a relatively small end 14 and which has an interior bore 16 defined by the inner surface 18 of the capillary wall. The bore 16 also tapers from the large end 12 inwardly to the small end 14. The capillary may be formed into its tapered shape by conventional drawing processes, wherein a glass tube is heated and tension is applied to its opposite ends to cause the tube to stretch and draw out. As the tube is drawn, its diameter decreases substantially uniformly, producing a thin-walled capillary having a very small aperture at its smallest end. The tube may be of a fused silica; however, a higher density glass, such as lead glass, is preferred since it has better X-ray reflecting properties. Various manufacturing procedures may be used to produce the capillary, but such techniques are well known, and do not constitute a part of this invention.

It has been found that a tapered, thin-walled capillary can be used to concentrate X-rays entering into the large end of the capillary if they are directed in such a way that they strike the inner surface 18 of the capillary at or below some angle less than the critical glancing angle. X-rays which enter the capillary and strike surface 18 at angles greater than the critical glancing angle will be absorbed by the wall of the capillary and will not pass through its length, while those which strike the wall surface at or below this angle will be reflected from that surface in the manner generally indicated by the dotted line 20 in FIG. 1 and will pass through the capillary, so that the capillary serves as a waveguide for these X-rays. As the reflected X-rays move from the larger end 12 toward the smaller end 14 of the capillary, they are in the form of a beam which is concentrated into a progressively smaller diameter aperture without any significant losses, so that the intensity of the beam continuously increases along the length of the capillary and the X-rays are, in effect, focused at a spot at or immediately adjacent the end 14 of the capillary. This spot is equal in diameter to the inner diameter of the end 14. Thus, the capillary reduces the diameter of the beam while increasing its intensity to provide concentrated X-ray energy at the end of the capillary. There are numerous applications for this technique of concentrating X-rays, including any use which requires high X-ray intensities at small spots.

From an X-ray optical viewpoint, there is no preferred range of capillary wall thickness; this dimension is a function of the manufacturing technique used to make the capillary. It is the inner diameter of the capillary that is important. In tests of the present invention, the capillaries used had wall thicknesses of about 40 microns.

Figure 2:
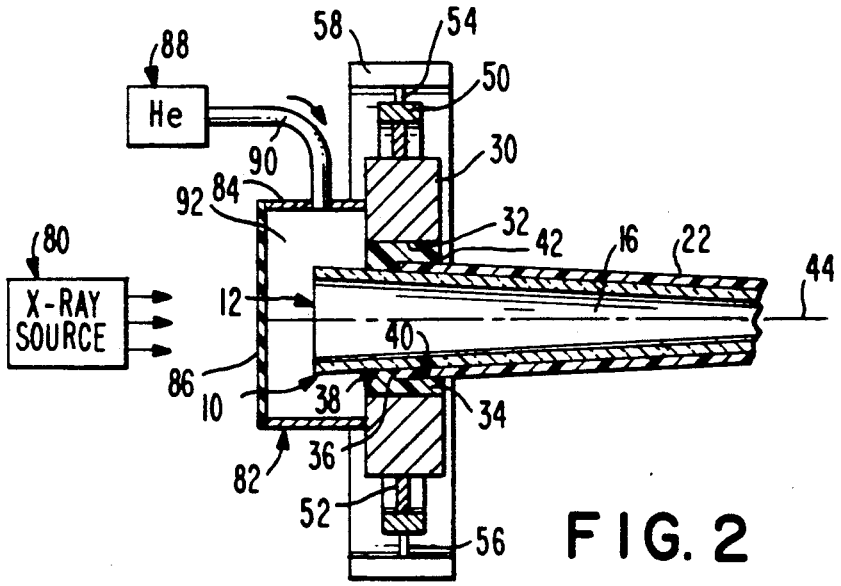
FIG. 2 is a cross sectional view of a support structure for mounting one end of a capillary.

As illustrated in FIG. 2, the capillary 10 preferably is coated by a plastic material 22 such as an epoxy acrylate. The acrylate layer may be applied to the outer surface of the capillary 10 after it has been drawn to the desired taper and diameter to protect the thin glass wall of the capillary and to give it strength and flexibility. The plastic coating is a thin, uniform layer which may be applied in a conventional manner. For example, after the capillary fiber has been heated and drawn to its tapered profile, it is air cooled to 50° C. and passed through a cup of uncured liquid epoxy acrylate. The coated fiber is then sent through a high intensity cylindrical source of ultraviolet light that cures the acrylate coating. The coating thickness can vary from a 50 micron wall thickness at the large end of the fiber to a 225 micron wall thickness at the small end.

Figure 3:
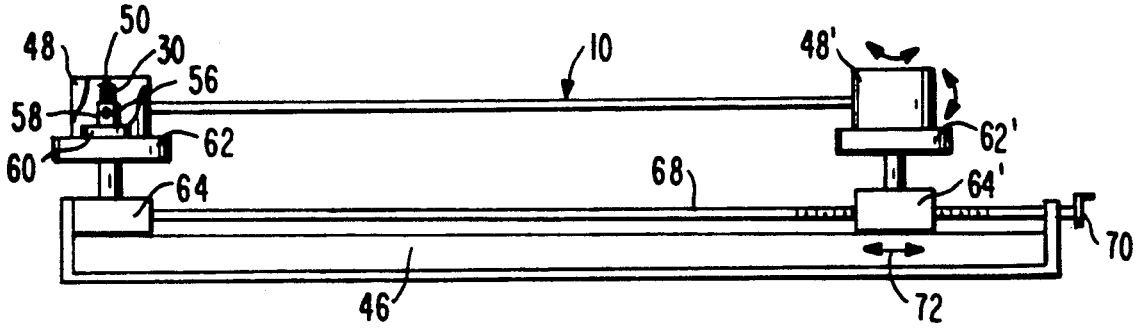
FIG. 3 is a diagrammatic illustration of capillary support apparatus in accordance with the present invention using the support structure of FIG. 2 at each end thereof.

In accordance with the present invention, both ends of the capillary are supported in the manner illustrated in FIG. 2 for the large end 12, it being understood that a similar mounting structure is used for the small end 14, as shown diagrammatically in FIG. 3. The support structure for the capillary includes, in the illustrated embodiment, an annular vertical mounting block 30 which incorporates an aperture 32 through which the end portion of the capillary extends. The aperture 32 is filled with an adhesive bonding material 34 which may be an epoxy material, and which is packed around the capillary in an uncured state. The epoxy is then cured to form an adhesive bond with the wall of the aperture 32 and with the exterior wall surface of the capillary. When cured, the bonding material 34 has sufficient strength to secure the capillary in the mounting block when tension in the axial direction is applied to it, as will be described.

It has been found that if the plastic coating 22 extends completely through the aperture 32 so that the epoxy 34 contacts only the outer surface of the plastic coating 22, insufficient strength is provided to hold the capillary in tension, for when the epoxy is connected to the coating 22, the coating tends to break loose from the surface of the glass when the capillary is subjected to tension. This allows the capillary to slide longitudinally with respect to the coating and thus with respect to the mounting block, thereby releasing the tension. The angle of taper of the capillary is exaggerated in FIG. 2 for purposes of illustration, but in actual tests, wherein the degree of taper was much less than the illustrated taper, the slippage between the plastic coating 22 and the glass capillary 10 allowed the capillary to slide out of the mounting block when the blocks were moved apart to apply tension to the capillary. The epoxy did not break free from the coating, but the coating did not did not stay attached to the glass.

A solution to the foregoing problem is the construction illustrated in FIG. 2, which involves stripping the plastic coating 22 away from at least a part of the end portion of the glass tube so that the coating terminates at an end 36 approximately midway through the aperture so that the bonding material 34 contacts the outer surface of the glass. The epoxy 34 bonds to the glass in the region 38 with sufficient strength to hold the capillary in the mounting block when axial tension is applied to the capillary. An additional advantage of the construction illustrated in FIG. 2 is the fact that the plastic coating 22 extends at least partially into the aperture 32 where it is in contact with, and is gripped by the bonding material 34 in the end region generally indicated at 40. This arrangement provides a cushioning effect at the point 42 where the capillary enters the bonding material 34, the plastic coating material thereby serving as a strain relief for the glass wall of the capillary to prevent breakage of the glass from the shear force applied to the capillary at point 42 by its weight. It was found that if the plastic coating 22 is stripped away from the capillary throughout the axial length of the aperture 32, so that the epoxy 34 contacts only the glass surface, a shear force is generated at the edge 42 of the epoxy which results in easy breakage of the capillary.

The mounting block 30 illustrated in FIG. 2 and a matching mounting block 30' (FIG. 3) at the opposite end of the capillary are used to secure the tapered glass capillary 10 and to apply axial tension to it so that it is linear to within a a few arcseconds resolution to enable X-rays to propagate down the bore 16 of the capillary without being absorbed by the capillary wall. In order to apply the required tension, the mounting blocks 30 and 30' are mounted for longitudinal motion in the direction of the longitudinal axis 44 of the capillary on an optical rail 46 (see FIG. 3) with the capillary 10 stretched between the two mounting blocks. The mounting blocks may be located in housings 48 and 48', as by means of a suitable gimbal mount diagrammatically illustrated in FIG. 2 by inner gimbal ring 50 in which the mounting block 30 is secured, as by a mounting ring 52. The inner ring 50 is pivotally mounted by pins 54 and 56 to a gimbal outer support 58 for motion about a horizontal axis. The gimbal ring 58 may, in turn, be mounted on a rotatable base 60 for pivotal motion about a vertical axis, as illustrated in FIG. 3 in housing 48, which is broken away to better illsutrate the gimbal mounting. The gimbal mounting preferably is a motor-driven, adjustable precision mounting which permits precise alignment of the mounting block with the longitudinal axis of the capillary. A suitable gimbal mounting is the Oriel Motorized Mirror Mount, equipped with a "Motor Mike" precision drive, manufactured by Oriel Corporation, Stratford, Conn. This mounting permits alignment of the end portions 12 and 14 of the capillary with the main body portion thereof between the mounting blocks, so that the capillary remains essentially straight along its entire axial length.

The housings 48 and 48' are mounted on the optical rail for relative motion parallel to the longitudinal axis 44 of the capillary which is stretched between them. Thus, for example, the housing 48 may be secured to a mounting platform 62 carried by a support base 64 fixed to the optical rail. The corresponding housing 48' is secured to a corresponding platform 62' which is also carried by a support base 64', which in this case preferably is a traveler movably mounted on the optical rail 46. The traveler is positionable by means, for example, of a threaded drive rod 68 which may be motor driven or manually operated by means of a hand wheel 70. The housing 48' is movable longitudinally along the drive rod 68 in the directions indicated by the arrow 72 so as to apply a selected amount of tension to the capillary 10. By rotation of the drive rod 68, the traveler 64' is moved longitudinally with respect to the fixed base 64 so that the capillary 10 can be pulled taut to effectively eliminate sag in the capillary and to insure that its longitudinal axis 44 is linear. The gimbal mounting for the mounting blocks 30 (and 30' for housing 48'), which permits the ends of the capillary to be aligned with the longitudinal axis between the two mounting blocks, insures a straight path completely through the capillary bore 16 for the propagation of X-rays.

X-rays from a suitable X-ray source, diagrammatically illustrated at 80 in FIG. 2, are directed into the large end 12 of the capillary after it has been fastened to the mounting blocks 30 and 30', the blocks have been secured in the housings 48 and 48', and tension has been applied to the capillary by adjustment of the traveler 64'. The application of sufficient tension, together with precise adjustment of the gimbal mounting allows the axis of the capillary to be aligned within a few arcseconds precision, and through the adjustment of the gimbals and the tension of the capillary, X-ray flux through the capillary is maximized. Since, for the propagation of X-rays, the critical angles for total reflection are on the order of milliradians, and since the cladding material 22 and the glass wall of the capillary 10 absorb X-rays rather than propagating them, the requirements for maintaining a straight axial line through the capillary are very high, and are much greater, for example, than would be the requirements for propagating light through an optical fiber.

In order to further maximize the propagation of X-rays through the capillary, the large end 12 of the capillary is enclosed by a gas-tight enclosure 82 including side walls 84, which may be metal, for example, and an end wall 86 formed of X-ray transparent material such as Kapton tape. Helium gas is supplied from a source 88 by way of an inlet 90 to the interior 92 of the enclosure 82 under slight pressure so that the helium flows through inlet end 12 into the interior bore 16 of the capillary. The helium flows through the capillary and exits from the aperture at the small end 14, thereby filling the capillary and displacing the air. A small flow of helium into the large opening 12 of the capillary translates into a larger flow rate exiting from the small opening 14, with the flow exerting sufficient force to clear air out of the capillary. Since helium is transparent to X-rays, a significant increase in the flux density of X-rays at the output end 14 is attained. For example, with X-rays having an energy level of 8 keV an air-filled capillary 1.6 meters long has its flux density reduced by a factor of 5 due to the absorption of X-rays in air. At lower X-ray energies, this loss is even greater. However, substituting helium for air increases the 8 keV X-ray flux by 5 times. It is noted that the helium exiting the small end of the capillary may be recaptured, if desired, but can be allowed to dissipate since the flow rate is very low.

In a test of the present invention, a capillary 1.6 meters long and having a diameter of 470 micrometers at its large end 12 and 110 micrometers at its small end 14 was mounted in the manner described above. The capillary was gripped at its two ends by means of mounting blocks such as those illustrated at 30 and 30' and was pulled straight by applying longitudinal tension to the capillary. The tensile strength of the glass was sufficient to substantially eliminate sag in the capillary, and the adhesive bonding in the manner illustrated prevented shear forces from breaking the glass at its securing points. The metal/glass bond did not separate, and the metal/acrylate bond served as a strain relief. The use of a gimbal mounting at the ends of the fiber permitted precise alignment of the capillary axis, and the use of helium within the capillary bore further maximized the density of the X-rays at the small-end opening of the capillary, thereby effectively focusing the X-rays to a high intensity spot having a diameter of 110 micrometers.

The provision of a plastic coating on the X-ray capillary provides another unexpected advantage. It has been found that such a coating provides a degree of flexibility to the thin glass capillary, enabling the capillary to be curved into an arc of a relatively large radius; for example, several meters, without breaking. It has been found that such a smoothly curved, large-radius arc will still propagate X-rays, although there is some absorption, and such a curvature allows an X-ray beam to be redirected. This is important, because present X-ray technology can steer a beam only over a limited angular range of about 0.3 degrees. Thus, for example, a synchrotron source generally directs its output X-rays horizontally, and present day X-ray optics do not permit such beams to be significantly redirected. However, with a carefully supported large-radius curved capillary, the output X-rays from a synchrotron could be directed vertically or in any direction in the horizontal plane.

Although the present invention has been described in terms of a preferred embodiment thereof, it will be understood that variations and modifications may be made without departing from the true spirit and scope thereof. Thus, for example, variations in the mounting mechanism on the optical rail may be utilized, and the gimbal mounts diagrammatically illustrated in the drawings preferably will be precision mounts which may be adjusted for accurate alignment. Accordingly, the true spirit and scope of the invention is limited only by the following claims.

What is claimed is:

1. Apparatus for guiding X-rays, comprising: a glass capillary having an outer surface and a tapered, elongated bore having a relatively large first end and a relatively small second end, the bore being defined by a thin glass wall;

cladding means on at least a part of the outer surface of said capillary for strengthening the glass wall thereof;

support means for at least one end of said capillary, said support means including mounting means and adhesive means fastening said mounting means to said outer surface of said capillary and to said cladding means; and means for applying tension to said capillary.

2. The apparatus of claim 1, said apparatus further including means introducing helium into said capillary bore.

3. The apparatus of claim 1, wherein said support means includes a mounting block for each end of said capillary, and adhesive means securing a first mounting block to a first end of said capillary and a second mounting block to a second end of said capillary, said adhesive means connecting each block to the outer surface of the capillary and to the cladding at corresponding ends thereof.

4. The apparatus of claim 3, wherein said support means includes means for moving one of said mounting blocks with respect to the other for applying tension to said capillary.

5. The apparatus of claim 4, wherein each said mounting block includes means for receiving a corresponding end portion of said capillary, for receiving at least an end portion of said cladding means, and for receiving said adhesive means for securing said capillary and said cladding means to said mounting block.

6. The apparatus of claim 5, further including gimbal means for said mounting blocks.

7. The apparatus of claim 5, further including means securing said mounting blocks for relative motion to apply tension to said capillary along a longitudinal axis thereof.

8. The apparatus of claim 7, further including adjustable means for aligning the end portions of said capillary with the longitudinal axis of the capillary.

9. The apparatus of claim 8, wherein said adjustable means comprises gimbal means for said mounting blocks.

10. The apparatus of claim 5, wherein each said mounting block includes an aperture for receiving a corresponding end portion of said capillary, the ends of said capillary extending through said apertures.

11. The apparatus of claim 10, wherein said cladding means is a plastic coating on said capillary, said coating extending substantially the entire length of said capillary and extending into, but not completely through, the corresponding apertures.

12. The apparatus of claim 11, wherein said adhesive means is located within said apertures to engage the end portions of said capillary and said cladding means.

13. The apparatus of claim 12, wherein said mounting blocks are adjustable to align the end portions of said capillary.

14. The apparatus of claim 13, further including gimbal means for said mounting blocks.

15. The apparatus of claim 14, further including means for introducing helium into said capillary bore under pressure to produce a slow flow of helium therethrough.

* * * * *